US005885361A

United States Patent [19]

Kikuchi et al.

[11] Patent Number: 5,885,361

[45] Date of Patent: Mar. 23, 1999

[54] CLEANING OF HYDROGEN PLASMA DOWN-STREAM APPARATUS

[75] Inventors: Jun Kikuchi; Shuzo Fujimura, both of Kawasaki, Japan

[73] Assignee: Fujitsu Limited, Kawasaki, Japan

[21] Appl. No.: 434,715

[22] Filed: May 4, 1995

[30] Foreign Application Priority Data

Jul. 25, 1994 [JP] Japan ..... 6-172943

[51] Int. Cl.[6] ..... B08B 7/00

[52] U.S. Cl. ..... 134/1.1; 134/1.2; 134/1.3; 134/2; 134/18; 134/22.1; 134/22.11; 134/30; 216/67; 216/69

[58] Field of Search ..... 134/1.1, 1.2, 1.3, 134/2, 18, 22.1, 22.11, 30; 216/67, 69

[56] References Cited

U.S. PATENT DOCUMENTS

| | | | |
|---|---|---|---|
| 4,201,579 | 5/1980 | Robinson et al. | 430/323 |
| 5,356,478 | 10/1994 | Chen et al. | 134/1.1 |
| 5,478,403 | 12/1995 | Shinagawa et al. | 134/1.1 |
| 5,500,393 | 3/1996 | Nishibayashi et al. | 134/1.2 |
| 5,620,526 | 4/1997 | Watatani et al. | 134/1.1 |
| 5,620,559 | 4/1997 | Kikuchi | 438/723 |

FOREIGN PATENT DOCUMENTS

| | | | |
|---|---|---|---|
| 1306582 | 12/1989 | Japan | 134/1.1 |

*Primary Examiner*—Zeinab El-Arini
*Attorney, Agent, or Firm*—Staas & Halsey

[57] ABSTRACT

A method of cleaning a hydrogen plasma down-stream apparatus for processing a material in a process chamber by guiding a down-stream of hydrogen plasma generated in a plasma generating space onto the material via a gas flow path with an inner main portion thereof being made of quartz, wherein plasma of a gas containing hydrogen, preferably containing hydrogen and water vapor, is generated in the plasma generating space, nitrogen fluoride is added at a down-stream position from the plasma, and a down-stream of the plasma is directed to the process chamber to clean the gas flow path. Amount of hydrogen radicals can be monitored by a metal sheath thermocouple. A hydrogen plasma down-stream apparatus suitable for removing a native oxide film or a resist film on the surface of silicon can be efficiently cleaned without disassembling it.

13 Claims, 10 Drawing Sheets

(PRESENT)

(REFERENCE)

CLEANING OF HYDROGEN PLASMA DOWN-STREAM APPARATUS

BACKGROUND OF THE INVENTION a) Field of the Invention

The present invention relates to a hydrogen plasma down-stream processing technology particularly suitable for removing native oxide or resist on the surface of silicon. In this specification, the term "hydrogen plasma" means plasma of a gas containing hydrogen and includes not only plasma of only hydrogen but also plasma of a mixed gas of hydrogen and another gas.

b) Description of the Related Art

Native oxide on the surface of semiconductor has become an issue of recent semiconductor device manufacturing processes.

The surfaces of most semiconductors and metals are easily oxidized in the air and form native oxide films. A native oxide film formed on the surface of a Si substrate is called an imperfect silicon oxide film and has a thickness of about 2 nm (measured by an ellipsometer). A native oxide film is generally an oxide film formed naturally on the surface of material left in the air. In this specification, the term "native oxide film" is not limited only to such a film, but includes also an imperfect oxide film about 2 nm or less formed on the surface of material subjected to acid treatment or other processes.

A native oxide film on an Si substrate surface is a silicon oxide film having an imperfect crystallinity and having a film quality inferior to a thermally oxidized Si film. As the size of a MOSFET is scaled down, the gate oxide film is becoming as thin as 10 nm or less. For example, in the case when a gate oxide film of 5 nm thick is to be formed, if a poor quality native oxide film of 2 nm thickness is left on the surface of an Si substrate, a resultant gate oxide film will have degraded film characteristics, as a whole.

A wet process using diluted hydrofluoric acid is known as a process for removing a native oxide film on an Si substrate (G. S. Higashi et al., Appl. Phys. Lett., 56, p.656, 1990). A native oxide film on the surface of a Si substrate immersed in a diluted hydrofluoric acid solution dissolves to expose a bare Si surface, and hydrogen atoms terminate dangling bonds at the Si substrate surface.

Although native oxide film removal using diluted hydrofluoric acid forms a stable Si substrate surface on the (1 1 1) plane, it forms a surface with a lower stability on the (1 0 0) plane. This wet process using diluted hydrofluoric acid has some difficulty in directly succeeding to the next dry process, from the viewpoint of a danger that the Si substrate surface may be again oxidized while the substrate is transported to a dry process system.

Attention has been paid recently to processing the surface of semiconductor by using hydrogen atoms. This is because a reducing gas usable in semiconductor device manufacturing is almost only hydrogen. For example, it has bee reported that hydrogen plasma is effective for removing a resist layer used as an ion implantation mask (S. Fujimura, et al., J.J.A.P. 28, p.2130, 1989).

Another known method of removing a native oxide film on a Si substrate is a dry process using hydrogen plasma (A. Kishimoto et al., Jpn. J. Appl. Phys. 29, p.2273, 1990). This technique can essentially and easily be followed by the next dry process because a native oxide film on a Si substrate can be removed by the dry process. However, since a Si substrate is exposed in plasma, the surface thereof may be damaged by collision of high energy particles such as ions and electrons.

It is considered that a native oxide film on the surface of a semiconductor can be removed by action of hydrogen atoms (radicals). A semiconductor substrate placed in hydrogen plasma and radiated with hydrogen radicals has a high possibility of being damaged by high energy particles in the plasma.

One approach to avoiding damages of a semiconductor substrate by plasma is to place the substrate at a down-stream position from the plasma, i.e., to place it down-stream from the plasma where high energy particles are scarce.

However, processing a semiconductor substrate down-stream from the hydrogen plasma poses a new problem that hydrogen atoms (radicals) easily recombine in a region down-stream from the plasma and they become hydrogen molecules. Because a metal surface increases the probability of recombination of hydrogen atoms (radicals), the inner wall of a gas flow path is usually made of fused quartz (silica). If high energy particles in plasma are to be better extinguished, the hydrogen atom concentration should inevitably be lowered greatly such that the process speed becomes slow.

The present inventors have proposed a method of introducing a great number of hydrogen atoms to a semiconductor substrate in the plasma down-stream region by adding water vapor to hydrogen plasma (for example, J. Kikuchi et al. J.J.A.P. 32, p.3120, 1993). Water vapor added to hydrogen plasma prevents hydrogen atoms from being changed to hydrogen molecules, and the hydrogen atoms continue to exist in the plasma down-stream. The reason for this may be a reaction of water vapor with the $SiO_2$ surface on the inner wall of a processing chamber or the like, which reaction suppresses recombination of hydrogen atoms on the $SiO_2$ surface.

If the $SiO_2$ surface is contaminated by some substance attached to the surface, it becomes difficult to introduce a great number of hydrogen atoms to the down-stream region irrespective of addition of water vapor. This difficulty may be ascribed to promotion of recombination of hydrogen atoms (radicals) at the attached contaminant region. Although substance attached to the $SiO_2$ surface and losing the function of additive water vapor is not certain, it has been confirmed that ethyl alcohol attached to the surface loses the effect of water vapor. For example, if the $SiO_2$ surface is wiped with a cloth impregnated with ethyl alcohol, hydrogen atoms reduce considerably. Therefore, contaminants losing the function of water vapor may supposedly be carbon, organic material, and other materials.

Contamination may be generated while a substrate is processed, by compositions of the air when a processing chamber is exposed thereto, or other causes.

If the inner wall of a hydrogen plasma down-stream apparatus is contaminated, it is necessary to clean the $SiO_2$ surface. Cleaning is carried out by dipping the $SiO_2$ part or surface, for example, in hydrofluoric acid aqueous solution, rinsing it with pure water, and drying it. For such cleaning, $SiO_2$ components are required to be disassembled from the down-stream apparatus, to be cleaned, and to be reassembled. It is also required to be careful enough not to again contaminate the $SiO_2$ surface during custody and transport after cleaning.

If contamination is overlooked and a hydrogen plasma down-stream process is performed, a target result of the process cannot be obtained or it takes a long time to complete the process.

SUMMARY OF THE INVENTION

It is an object of the present invention to provide a method of cleaning a hydrogen plasma down-stream apparatus capable of efficiently cleaning the apparatus without disassembling it.

It is another object of the present invention to provide a method of manufacturing a semiconductor device capable of efficiently manufacturing a semiconductor device by using a hydrogen plasma down-stream apparatus.

According to one aspect of the present invention, there is provided a method of cleaning a hydrogen plasma down-stream apparatus for processing a material in a process chamber by directing a down-stream of hydrogen plasma generated in a plasma generating space onto the material via a gas flow path with an inner main portion thereof being made of silicon oxide, the method including the steps of: generating plasma of a gas containing hydrogen in the plasma generating space; and directing a down-stream of the plasma to the process chamber and cleaning the gas flow path.

According to another aspect of the present invention, there is provided a method of manufacturing a semiconductor device by using a hydrogen plasma down-stream apparatus for processing a material in a process chamber by guiding a down-stream of hydrogen plasma generated in a plasma generating space onto the material via a gas flow path with an inner main portion thereof being made of silicon oxide, the method including the steps of: generating plasma of a gas containing hydrogen in the plasma generating space, directing a down-stream of the plasma to the process chamber, and cleaning the gas flow path; transporting a semiconductor substrate into the process chamber; and generating plasma of a gas containing hydrogen in the plasma generating space and gas phase processing the semiconductor substrate in the process chamber.

The inventors have confirmed from experiments that even if sufficient hydrogen atoms do not reach a material to be processed by hydrogen plasma down-stream, sufficient hydrogen atoms will reach the material if the hydrogen plasma down-stream is continued thereafter for a sufficient time period. Hydrogen atoms are considered to clean contaminants such as carbon and organic material on the surface of silicon oxide. Therefore, even if there are contaminants on the inner wall of a hydrogen plasma down-stream apparatus, a clean surface of $SiO_2$ can be obtained by hydrogen plasma down-stream, and the effect of additive water vapor is considered to be recovered.

Contaminants on the surface of silicon oxide of a hydrogen plasma down-stream apparatus can therefore be removed by hydrogen plasma down-stream.

A hydrogen plasma down-stream apparatus can be cleaned by hydrogen plasma down-stream before a material to be processed is transported into a process chamber.

The efficiency of hydrogen plasma down-stream is high if the inner wall of a hydrogen plasma down-stream apparatus is made of fused quartz.

The cleaning effects can be enhanced by adding molecules containing one or more oxygen atoms to hydrogen and flowing down-stream a number of hydrogen atoms. Typically, water vapor is added.

After the cleaning process, a hydrogen plasma down-stream process for a material to be processed can be efficiently performed in a short time.

As above, contaminants on the surface of $SiO_2$ of a hydrogen plasma down-stream apparatus can be removed by using hydrogen atoms. At the next hydrogen plasma down-stream process, recombination of hydrogen atoms can be suppressed and a number of hydrogen atoms can be transported to the material to be processed. It is possible to maintain a stable high process speed of hydrogen plasma down-stream. The cleaning process can be performed by a gas phase process without disassembling the hydrogen plasma down-stream apparatus.

A semiconductor device can be manufactured reliably in good conditions by performing a hydrogen plasma down-stream process after the hydrogen plasma down-stream apparatus is made clean.

DETAILED DESCRIPTION OF THE PREFERRED EMBODIMENTS

Figure 1:
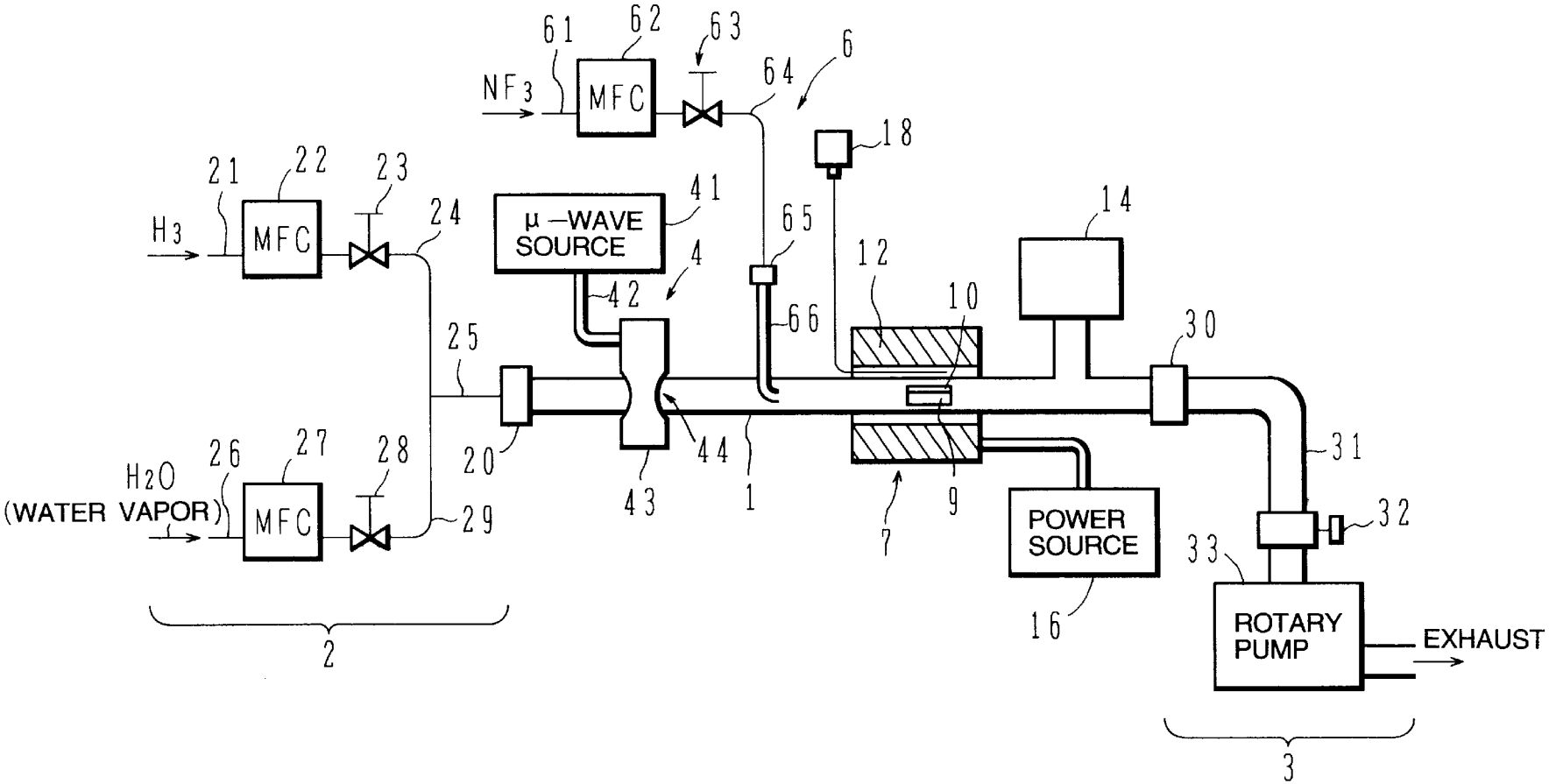
FIG. 1 is a schematic diagram partially in section showing the structure of a hydrogen plasma down-stream apparatus used for preparatory experiments.

FIG. 1 shows the structure of a hydrogen plasma down-stream processing system used for preparatory experiments. The experiments were conducted in order to study the effects of removing a native oxide film on a silicon substrate by using hydrogen radicals, and the processing system was constructed in a simple style.

Open ends of a quartz tube 1 having an inner diameter of about 9 mm are connected to a (hydrogen+water vapor) introducing system 2 and an evacuation system 3, respectively. The (hydrogen+water vapor) introducing system 2 includes a mass flow controller 22 connected to a hydrogen pipe 21, a valve 23 connected down-stream from the mass flow controller 22, a pipe 24 extending to a mixing point, a mass flow controller 27 connected to a water vapor pipe 26, a valve 28 connected down-stream from the mass flow controller 27, a pipe 29 extending to the mixing point, and a pipe 25 for supplying a mixed gas from the mixing point to a joint 20. A mixed gas of $H_2$+$H_2O$ having a desired mixing ratio can be supplied to the joint 20 by adjusting the mass flow controllers 22 and 27.

The evacuation system 3 includes a joint 30 connected to the quartz tube 1, a pipe 31, a valve 32, and a rotary pump 33. The inside of the quartz tube 1 can be evacuated to a desired degree of vacuum by adjusting the valve 32. A capacitance manometer 14 is connected to the quartz tube 1 near the down-stream end thereof, the manometer 14 being capable of measuring a vacuum degree within the quartz tube 1.

A gas excitation system 4 includes a microwave source 41, and a waveguide means 42 for guiding microwaves from the microwave source 41 to a microwave cavity 43. The waveguide means 42 is a coaxial cable in this embodiment. If the system scale is large, a hollow waveguide tube may be used as the waveguide means 42. The microwave cavity 43 can be divided into two parts which jointly enclose the quartz tube 1. The region of the quartz tube 1 surrounded by the microwave cavity 43 is a plasma generating region 44.

An additive gas introducing system 6 is connected to the quartz tube 1 at a down-stream position from the microwave cavity 43 by about 20 cm. The additive gas introducing system 6 includes a mass flow controller 62 connected to an $NF_3$ pipe 61, a valve 63 connected down-stream from the mass flow controller 62, a pipe 64 connected down-stream from the valve 63, a joint 65, and a coupling quartz tube 66 connected to the quartz tube 1. An $NF_3$ gas can be added at a desired flow rate by adjusting the mass flow controller 62.

A processing part 7 of the quartz tube 1 in which a silicon chip 9 with a native oxide film 10 is placed, is set at a down-stream position from the additive gas introducing system 6 by about 80 cm (although the processing part 7 is depicted nearer to the additive gas introducing system 6 in FIG. 1). A heater 12 surrounds the processing part 7. The temperature at the outer periphery of the quartz tube 1 is measured by a thermocouple 18. The heater 12 is supplied with a controlled current from a power source 16.

First, the reason why the additive gas introducing system 6 is installed at the down-stream position from the plasma generating region 44 by about 20 cm, will be described. As ($H_2$+$H_2O$) gas is introduced from the gas introducing system 2 and plasma is generated in the plasma generating region 44 by irradiating microwaves in the microwave cavity 43, the generated plasma flows down-stream, being conveyed by the gas flow. The plasma contains hydrogen ions and electrons of high energy state. These high energy particles may react with additive nitrogen fluoride gas and generate dangerous fluorine radicals. However, at the down-stream position from the plasma generating region 44 by about 20 cm, high energy particles (ions and electrons) can be considered to have extinguished almost completely.

$NF_3$ gas is added to ($H_2$+$H_2O$) gas. The experiment results were not good when $NF_3$ gas was introduced at a region where plasma is generated or still resident. For this reason, the additive gas introducing system 6 was connected to the down-stream position from the plasma generating region 44 by about 20 cm.

It was confirmed experimentally effective to introduce $NF_3$ gas at a region where high energy particles in plasma of ($H_2$+$H_2O$) mixed gas have extinguished, for removing a native oxide film on a silicon chip. By using the structure shown in FIG. 2, it was studied which down-stream position from the additive gas introducing system 6 was effective for placing a silicon chip.

An electron spin resonance (ESR) measuring apparatus 11 was set at the down-stream position from the additive gas introducing system 6 to detect hydrogen radicals in a reaction tube 1. The distance between the additive gas introducing system 6 and the ESR measuring apparatus 11 was changed among about 40 cm, 60 cm, and 80 cm. As the distance was set longer, the density of detected hydrogen radicals was higher. This indicates that hydrogen gas (or its derivatives) in a plasma state and $NF_3$ gas are considered to react with each other by some chemical reaction or reactions to increase hydrogen radicals. It has been found that by-products by this chemical reaction are effective for etching a native oxide film on a silicon chip.

In order to ensure a sufficient reaction, the processing part 7 was set at the down-stream position from the additive gas introducing system 6 by L2, about 80 cm.

The reason why the gas introducing system 2 introduces water vapor in addition to hydrogen gas is as follows. Under the condition that hydrogen gas only was introduced and plasma was generated, hydrogen radicals in the plasma rapidly reduced as the plasma gas flew down-stream in the quartz tube 1. In the case of a mixed gas of hydrogen gas and water vapor, the speed of reducing hydrogen radicals lowered greatly. It is considered that when water vapor is added to hydrogen gas, water vapor or OH radicals are physically adsorbed on the inner wall of the quartz tube 1 and reduce the reaction of hydrogen radicals at the tube inner wall. Accordingly, in order to extinguish hydrogen ions and electrons in plasma as much as possible and to flow hydrogen radicals as down-stream as possible, $H_2$+$H_2O$ mixed gas was introduced and the additive gas introducing system 6 was installed at the down-stream position from the plasma generating region by L1, about 20 cm.

With the above settings, a native oxide film 10 on a silicon chip 9 could be etched at a practically usable etch rate, by introducing $H_2$+$H_2O$ mixed gas from the gas introducing system 2, generating microwave plasma in the plasma generating region 44, and introducing $NF_3$ gas from the additive gas introducing system 6.

Since this native oxide film removing system uses a dry process, it can be easily coupled with other dry processing systems. For example, this native oxide film removing system may be used for a preparatory process for a film forming system such as a chemical vapor deposition (CVD) system and a sputtering system.

Although a mixed gas of hydrogen gas and water vapor was used in the experiments, other gases may by used in place of water vapor so long as they generate $H_2O$ in the plasma generating region. For example, a molecule containing at least one oxygen atom may be used.

The quartz tube constituting a chamber may be made of other materials containing silicon oxide.

Dangling bonds are exposed on the surface of a silicon chip after its native oxide film was removed. It is preferable to terminate dangling bonds by hydrogen or other atoms.

Next, a process capable of terminating dangling bonds with hydrogen atoms will be described.

Figure 3A:
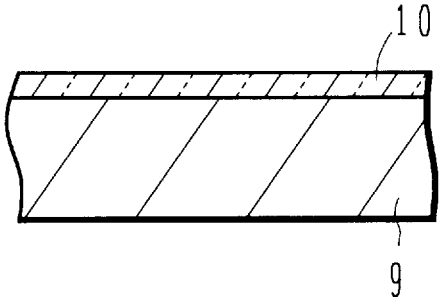
FIGS. 3A to 3C are schematic cross sectional views showing the structure of a silicon chip, illustrating each process of preparatory experiments.

The hydrogen plasma down-stream processing system shown in FIG. 1 was used, and a silicon chip 9 shown in FIG. 3A was used as a sample which has a native oxide film 10 of about 1.3 nm thickness. In order to facilitate a comparison to a conventional technique, the silicon chip 9 having the (1 1 1) plane was used.

The silicon chip 9 is placed in the processing part 7 of the processing system shown in FIG. 1. Thereafter, the inside of the quartz tube or chamber 1 is evacuated by the evacuation system 3. While the inside of the chamber 1 is evacuated, hydrogen gas is introduced from the gas introducing system 2 into the quartz tube 1 at a flow rate of 80 sccm.

Next, microwaves having a frequency of 2.45 GHz are introduced through the microwave cavity 43 into the plasma generating region 44 at about 20 W. As a result, hydrogen molecules in the plasma generating region 44 are dissociated to generate hydrogen ions, electrons, and radicals. Plasma gas is present only near the plasma generating region 44 and does not flow down-stream to the position of the additive gas introducing system 6. Hydrogen radicals flow down-stream to the position of the additive gas introducing system 6, being conveyed by the gas flow.

$NF_3$ gas is introduced from the additive gas introducing system 6 into the chamber 1 at a flow rate of 90 sccm. $NF_3$ gas is mixed and reacted with hydrogen gas containing its radicals.

Thereafter, water vapor is additionally introduced from the gas introducing system 2 at a flow rate of 20 sccm to add $H_2O$ to the hydrogen plasma. The pressure of the inside of the chamber 1 is controlled to be about 3 Torr.

If $H_2O$ is not added, most of hydrogen radicals in activated gas flowing down-stream from the plasma generating region are transformed into hydrogen molecules through recombination at the inner wall of the quartz tube 1. If $H_2O$ is added, reduction of hydrogen radicals is suppressed considerably and hydrogen radicals not negligible in amount flow down-stream to the position of the additive gas introducing system 6. Activated gas containing hydrogen radicals and $NF_3$ gas react with each other by some chemical reaction or reactions as they flow down-stream in the quartz tube 1.

Figure 3B:
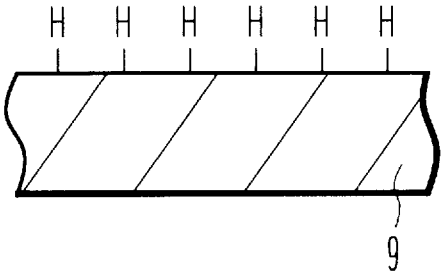

As this state is maintained for 15 minutes, the native oxide film 10 on the silicon chip 9 is removed as shown in FIG. 3B, and a hydrogen terminating process continues so that hydrogen atoms are coupled to dangling bonds on the surface of the silicon chip 9.

Whether a native oxide film is present or not was judged depending on whether the surface of a silicon substrate is hydrophilic or hydrophobic. It was judged that a native oxide film 10 is present if hydrophilic, and that a native oxide film 10 has been removed if hydrophobic.

In order to terminate the native oxide film removing process, the supply of water vapor gas and $NF_3$ gas was stopped in this order. Thereafter, the supply of microwaves was stopped to terminate the generation of plasma, and then the supply of hydrogen gas was stopped.

With the above process, a native oxide film can be removed by hydrogen radicals in a time of the order of 15 minutes or shorter, as compared to the conventional technique which requires the removal time in the order of hours.

Furthermore, a silicon chip is processed at the position more down-stream than the position where $NF_3$ gas is added, the latter position being more down-stream than the region where the plasma (positive and negative charges) generated at the plasma generating region almost extinguishes. The chemical reaction by radicals becomes dominant so that damage to a silicon chip caused by high energy particles is suppressed. Still further, the silicon surface becomes chemically stable because dangling bonds on the silicon surface are considered to be terminated by hydrogen atoms.

As the sequential order of processes, it is preferable to introduce hydrogen gas, generate plasma, introduce $NF_3$ gas, and introduce water vapor gas in this order, and to stop the supply of these gases in the reverse order. For example, if the supply of water vapor is stopped last, there is a fear that an oxide film may be formed on the silicon chip surface by water vapor.

Figure 3C:
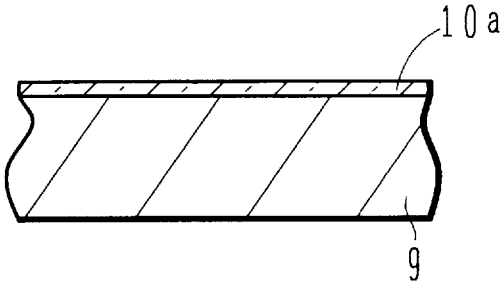

Etching without adding nitrogen fluoride gas was tested. A silicon chip was processed by the same conditions and processes as the above-described embodiment except that nitrogen fluoride gas was not added. It was unable to fully remove the native oxide film even if the process was continued for 60 minutes or longer. The sample shown in FIG. 3A changed to the sample shown in FIG. 3C which is considered to have a native oxide film 10*a* left unetched.

A native oxide film was unable to be removed without causing damage to the substrate surface, when nitrogen fluoride gas was introduced into the quartz tube 1 at the position of the plasma generating region.

Figure 2:
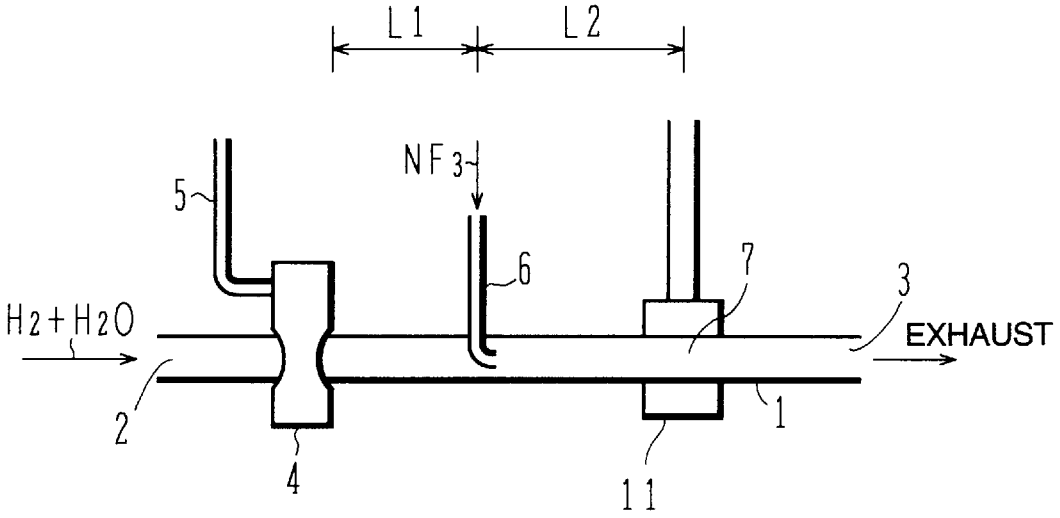
FIG. 2 is a schematic cross sectional view showing the structure used for evaluating the performance of the apparatus shown in FIG. 1.
Figure 4A:
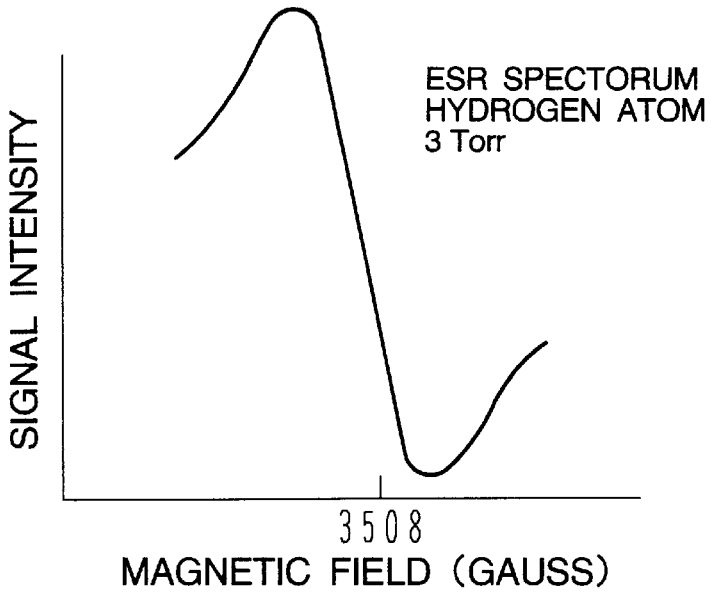
FIGS. 4A and 4B are graphs comparing the results of processes using the apparatus shown in FIG. 1 and the results of comparison processes.

In order to check this phenomenon, the amount of hydrogen radicals at the processing part 7 was measured by using the structure shown in FIG. 2. Activated gas flowed in the same manner as the above-described processes and spectra shown in FIG. 4A were obtained. The abscissa represents a magnetic field intensity in the unit of Gauss, and the ordinate represents a signal intensity in an arbitrary unit.

Figure 4B:
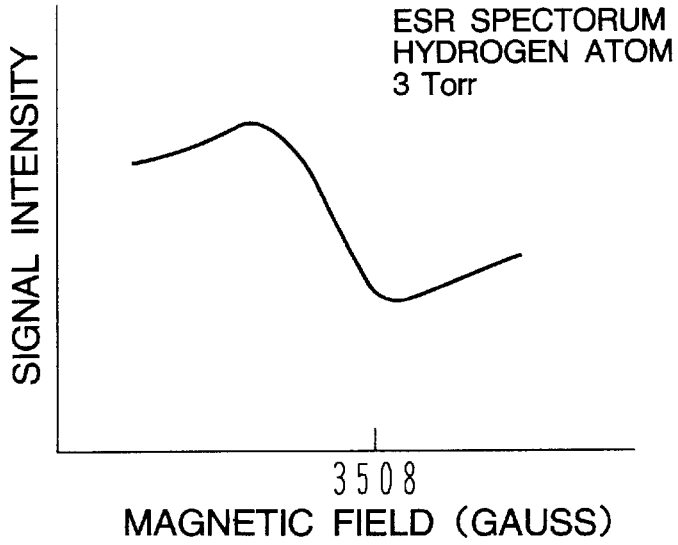

The results shown in FIG. 4B with the same abscissa and ordinate stand for a comparison example wherein $NF_3$ gas was not added and the other conditions were maintained the same as the embodiment. In these experiment results, it is considered that a difference between upper and lower peaks is approximately proportional to the number of hydrogen atoms.

From the experimental results, it can be understood that the number of hydrogen atoms for the above-described process is larger than that for the comparison example. Although the mechanism is not clearly known, addition of $NF_3$ gas is considered to produce a reaction or reactions which increase hydrogen radicals. A reaction between nitrogen fluoride gas and hydrogen gas (containing hydrogen radicals) is considered to promote a reaction of removing a native oxide film.

Next, a method of cleaning a hydrogen plasma down-stream apparatus according to an embodiment of the invention will be described with reference to FIGS. 5 to 7.

Figure 5:
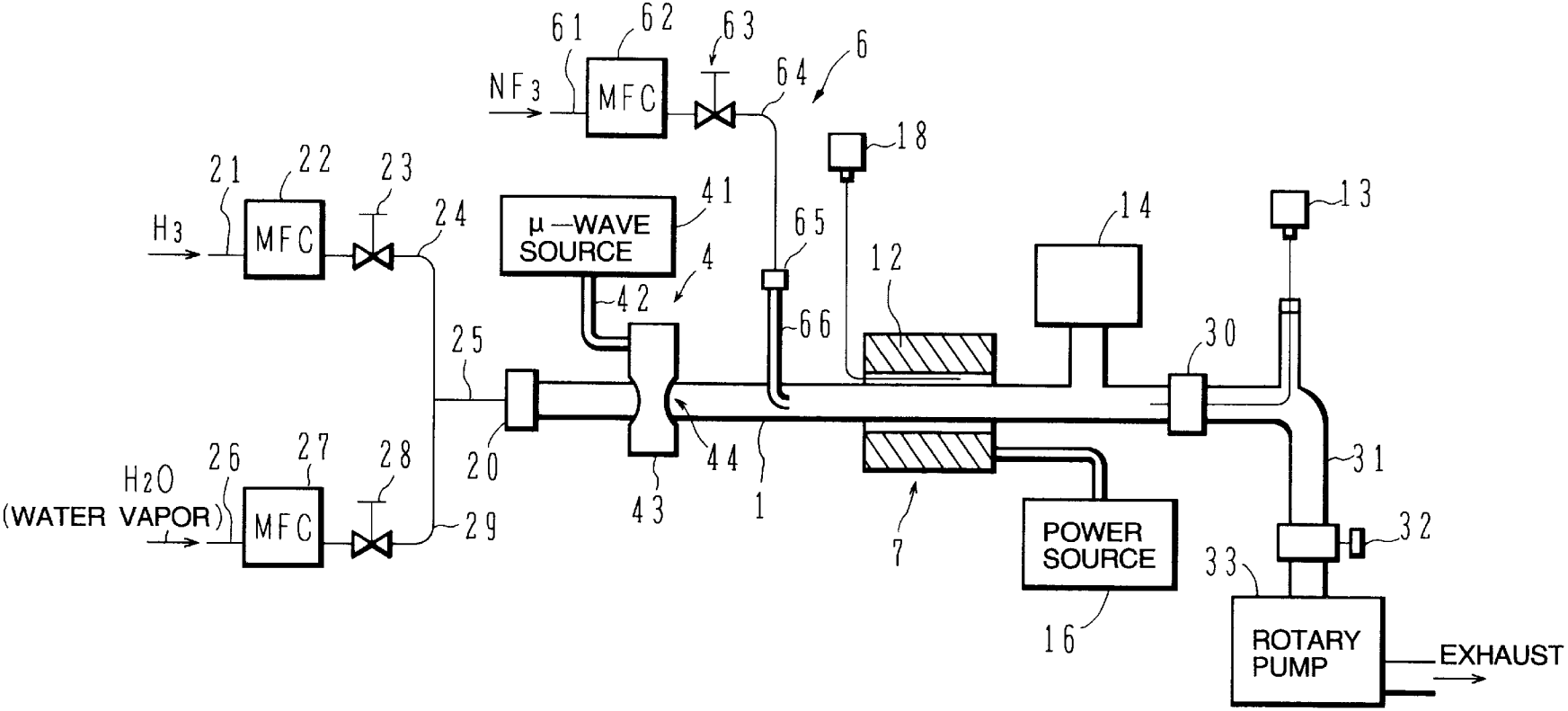
FIGS. 5 to 7 are schematic diagrams partially in section of a hydrogen plasma down-stream apparatus illustrating a method of cleaning according to an embodiment of the invention.

FIG. 5 is a schematic diagram partially in section of an apparatus for removing a native oxide film on a silicon substrate by hydrogen plasma down-stream. This apparatus has the same structure as the apparatus shown in FIG. 1, and has a thermocouple 13 mounted at a position down-stream from a processing space 7. FIG. 5 is a diagram illustrating a method of cleaning a hydrogen plasma down-stream apparatus, and a silicon substrate to be processed is not transported in a quartz tube 1 yet.

Similar to the apparatus shown in FIG. 1, the apparatus shown in FIG. 5 has a simplified structure for experiment use. The inner diameter of the quartz tube 1 is 9 mm. Similar to the structure shown in FIG. 1, an additive gas introducing system 6 is connected at a position down-stream from a microwave cavity 43 by about 20 cm. The processing space 7 is formed at a position down-stream from the additive gas introducing system 6 by about 80 cm.

The distal end of the thermocouple 13 is at a position down-stream from a plasma generating space 44 by about 120 cm. The thermocouple is of K type covered with stainless steel, and its outer diameter is about 1 mm. Recombination of hydrogen atoms to hydrogen molecules is promoted by the catalytic action on the surface of the metal which cover the thermocouple.

When hydrogen atoms are recombined, energy is released. Therefore, a temperature of the thermocouple rises. Hydrogen atom concentration can be measured indirectly by detecting a temperature of the thermocouple.

The apparatus shown in FIG. 5 is connected to an ESR measuring apparatus shown in FIG. 2. The ESR measuring apparatus is connected at a position down-stream from the plasma generating space by about 100 cm.

Hydrogen atom concentrations were measured by ESR under the conditions that a pressure in the quartz tube 1 was set to 3 Torr and a microwave power was set to 50 W, either by flowing only hydrogen gas at a flow rate of 100 sccm or by flowing both hydrogen gas at a flow rate of 80 sccm and water vapor at a flow rate of 20 sccm.

As compared to the hydrogen atom concentration measured when only hydrogen gas flowed, the hydrogen atom concentration measured when both hydrogen gas and water vapor flowed, increased to about 240-fold magnitude. It can be understood that recombination of hydrogen atoms on the surface of the quartz tube is suppressed by water vapor. The temperature of the thermocouple increased from 23° C. to 155° C. This temperature change is considered to correspond to a change in the hydrogen atom concentration.

The processes of cleaning the inner wall of the quartz tube 1 will be described with reference to the structure shown in FIG. 5. A substrate was not transported into the quartz tube 1. Hydrogen gas at 80 sccm and water vapor at 20 sccm flowed from the upstream position and plasma was generated in the plasma generating space 44 under the conditions that a pressure in the quartz tube was set to 3 Torr and a microwave power 50 W was supplied from the microwave source 41.

Temperature of the thermocouple was 155° C. at a steady state by using a clean quartz tube 1.

Plasma was generated under the same conditions after the inner wall of the quartz tube 1 was wiped with a cloth impregnated with ethyl alcohol. Temperature of the thermocouple reached a steady state at 27° C. in 30 seconds after the start of electric discharge. As the electric discharge continued thereafter, the temperature of the thermocouple gradually rose. After about 20 minutes, the temperature of the thermocouple rose to 155° C. to thereafter take a steady state. In the case of contamination by ethyl alcohol, it can be assumed that the inner wall of the quartz tube 1 is made clean by cleaning it for about 20 minutes under the above conditions.

As described above, the inner wall of the quartz tube 1 can be made clean by flowing plasma of hydrogen and water vapor through the tube 1 while monitoring the thermocouple 13.

Figure 6:
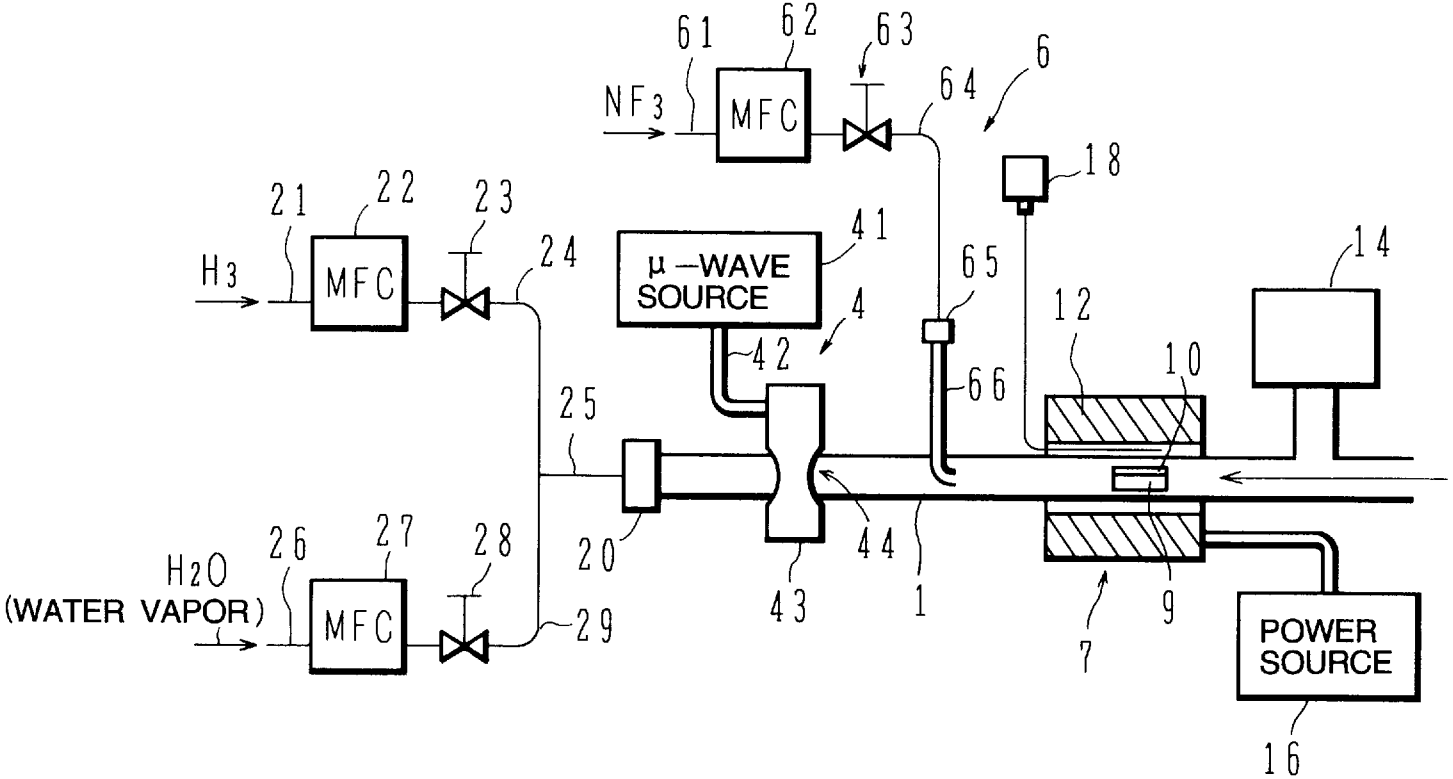

FIG. 6 illustrates the process of transporting a semiconductor substrate after the cleaning process. The joint 30 at a position down-stream from the processing space 7 of the quartz tube is dismounted after the cleaning process to open the down-stream end of the quartz tube 1. A silicon substrate 9 formed with a native oxide film 10 is transported via the open down-stream end of the quartz tube 1 to the processing space 7. The native oxide film 10 on the surface of the silicon substrate 9 was formed by sulfuric acid and hydrogen peroxide aqueous solution to a thickness of about 1.3 nm. The processing space 7 is at a position down-stream from the additive gas introducing system 6 by about 80 cm.

When the joint 30 is dismounted, the quartz tube 1 is exposed to the air. There is a possibility of contaminating the inner wall of the quartz tube while it is exposed to the air. Therefore, the period while the quartz tube 1 is exposed to the air, is desired to be made as short as possible. After the silicon substrate 9 is transported to the processing space 7, the pipe on the exhaust side including the thermocouple 13 is connected by the joint 30 as soon as possible. In this embodiment, the process of transporting the silicon substrate was completed in about one minute.

Figure 7:
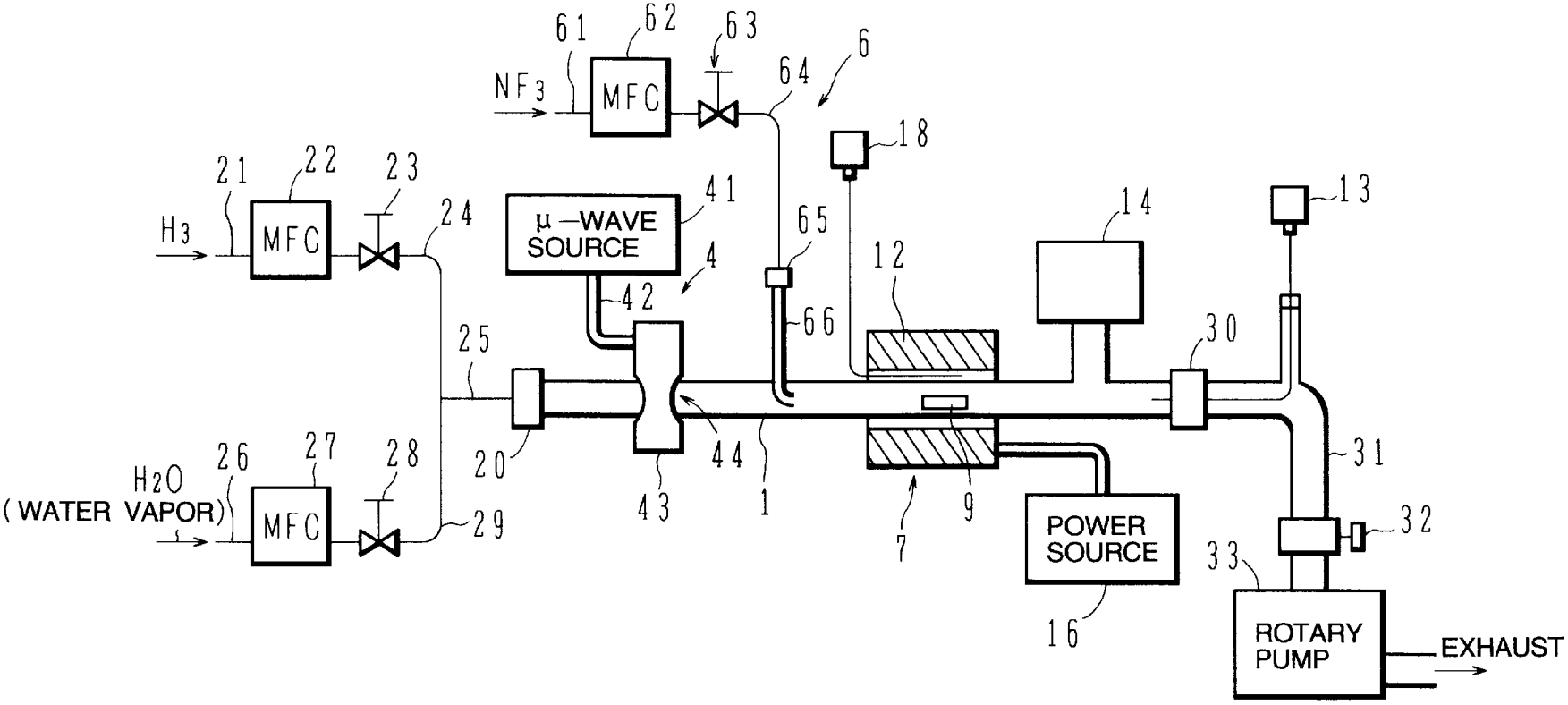

FIG. 7 illustrates the process of removing a native oxide film by using a cleaned hydrogen plasma down-stream apparatus. Hydrogen gas flowed at 80 sccm and a microwave power of 50 W was supplied to generate plasma of only hydrogen in the plasma generating space 44. Next, nitrogen fluoride ($NF_3$) gas was supplied at 90 sccm from the additive gas introducing system 6, and at the same time water vapor was supplied at 20 sccm from a water vapor introducing system.

A hydrogen plasma down-stream process was performed for 10 minutes while maintaining a pressure in the quartz tube at 3 Torr. Next, a supply of water vapor and nitrogen fluoride was stopped in this order, and then electric discharge was stopped. A pressure in the quartz tube 1 was reduced to 1 Torr while flowing hydrogen at 80 sccm, and the silicon substrate was heated at 100° C. for 3 minutes by using the heater 12. Thereafter, heating was stopped, a supply of hydrogen was stopped, and the joint 30 at the down-stream end of the quartz tube 1 was dismounted to pick up the silicon substrate 9. When pure water was poured on the silicon substrate, its surface indicated water repellency, which means the native oxide film 10 was removed.

In order to evaluate the cleaning effect, the following comparison experiments were performed. The inner wall of the quartz tube was wiped with a cloth impregnated with ethyl alcohol, the cleaning process illustrated with FIG. 5 was performed by only electric discharge for 30 seconds, and terminated at a thermocouple temperature of 27° C.

Thereafter, as shown in FIG. 6, a silicon substrate 9 with a native oxide film 10 was transported into the processing space 7 of the quartz tube 1, and the process of removing a native oxide film previously described with FIG. 7 was performed under the same conditions. The processed silicon substrate indicated no water repellency. This means that if the inner wall of the quartz tube 1 is not cleaned, the native oxide film cannot be removed completely under the same conditions.

The inner wall of the quartz tube 1 was wiped with a cloth impregnated with ethyl alcohol, plasma was generated under the same conditions, and after 30 seconds from the start of plasma generation, generation of the plasma was stopped. At this time, a temperature of the thermocouple rose only to 28° C.

The quartz tube was dismounted from the apparatus, dipped in 5% hydrofluoric acid aqueous solution for 30 minutes, rinsed in pure water for one hour, and dried thereafter. The quartz tube was then mounted on the apparatus, and the cleaning process previously described with FIG. 5 was performed. At this time, a temperature of the thermocouple rose to 156° C. after 30 seconds.

Thereafter, a silicon substrate with a native oxide film was transported, and the native oxide film removing process was performed under the same conditions. The surface of the processed silicon substrate indicated water repellency. It can therefore be understood that the cleaning process by hydrogen plasma down-stream for about 20 minutes has the same effect as the cleaning process using hydrofluoric acid aqueous solution.

The cleaning process described with FIG. 5 was also performed at a microwave power of 30 W for the quartz tube 1 wiped with a cloth impregnated with ethyl alcohol. In this case, a temperature of the thermocouple was 27° C. even after one hour after the start of plasma generation.

Thereafter, a silicon substrate with a native oxide film was transported, and the native oxide film removing process described with FIG. 7 was performed under the same conditions. The surface of the processed silicon substrate indicated no wafer repellency.

It can be understood from these comparison experiments that a hydrogen atom concentration can be detected by monitoring a temperature of the thermocouple and that an insufficient microwave power lowers the cleaning effect. If the inner wall of the quartz tube is contaminated, a native oxide film cannot be removed completely even if the native oxide film removing process is performed for the time period which allows a native oxide film in a clean quartz tube to be removed completely.

Figure 8:
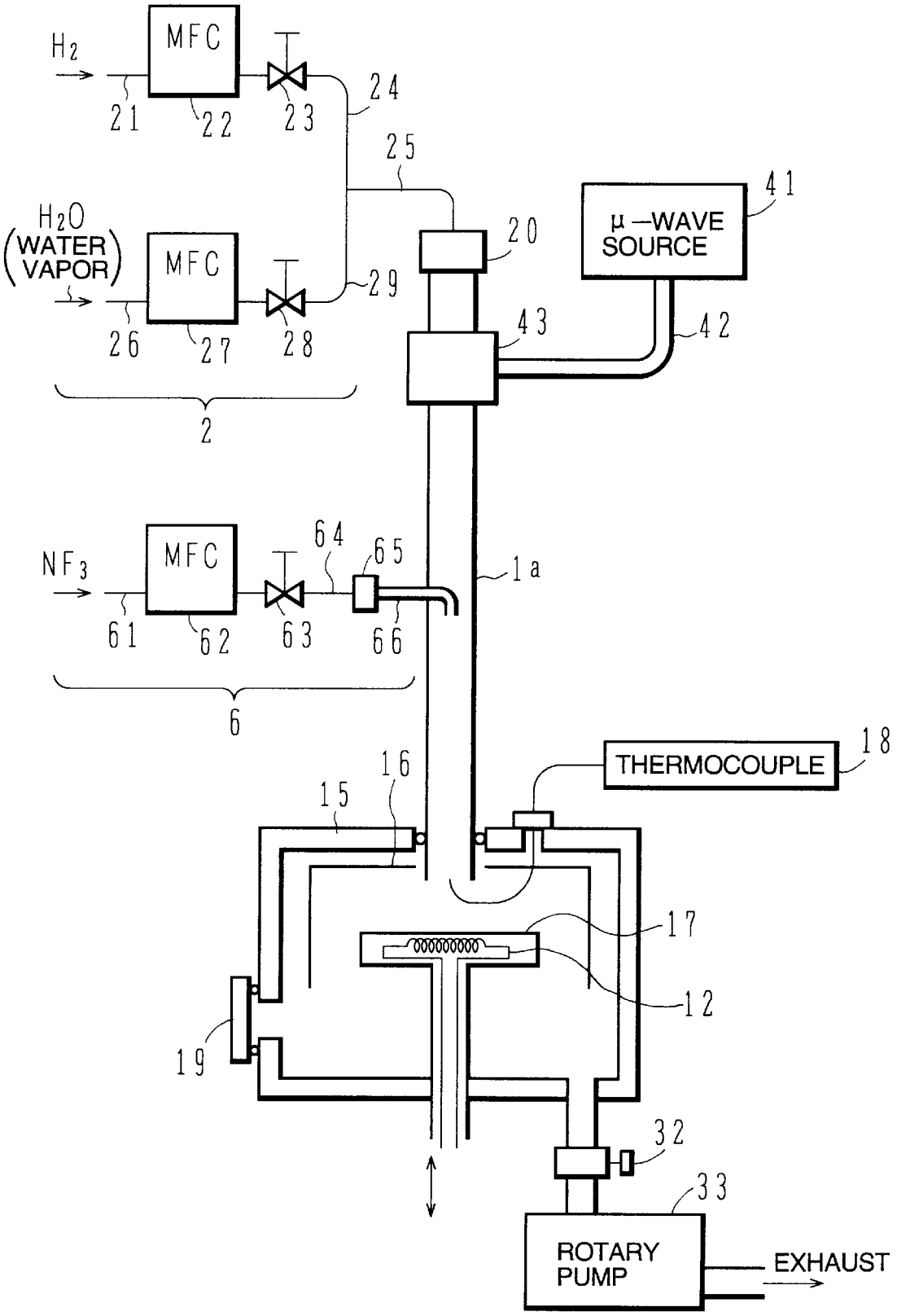
FIGS. 8 and 9 are schematic diagrams partially in section of a hydrogen plasma down-stream apparatus illustrating a method of cleaning according to another embodiment of the invention.

FIG. 8 shows a hydrogen plasma down-stream apparatus used by a cleaning process according to another embodiment. This apparatus has a fused quartz tube 1*a* having an inner diameter of 20 mm. A microwave cavity 43 is coupled to the quartz tube 1*a* to supply microwaves from a microwave source 41 via a waveguide unit 42. A discharge gas introducing system 2 having the structure described previously is connected via a joint 20 to the quartz tube 1*a* on the upstream side thereof. An additive gas introducing system 6 is connected at a position down-stream from the plasma gas generating space by 40 cm. These gas introducing systems are adapted to supply gases at flow rates matching the inner diameter of the quartz tube 1*a*.

The down-stream end of the quartz tube 1*a* is at a position down-stream from the additive gas introducing system 6 by 40 cm. A chamber 15 is connected to the down-stream end of the quartz tube 1*a*. The inner wall of the chamber 15 is covered with fused quartz bell jar. A wafer stage 17 movable up and down is disposed below the quartz tube 1*a*. A heater 12 is embedded in the wafer stage 17, and can heat a wafer placed on the wafer stage 17 up to 200° C.

A wafer port 19 is formed in the wall of the chamber 15 to put a wafer in the chamber or take it out of the chamber. A thermocouple 18 is mounted near the down-stream end of the quartz tube 1*a*. The inside of the chamber 15 can be evacuated by a rotary pump 33 via a valve 32.

With this structure, the chamber 15 of a large capacity is connected to the quartz tube 1*a*, and a semiconductor wafer transported in the chamber 15 can be subjected to a hydrogen plasma down-stream process. Concentration of hydrogen atoms supplied to the wafer can be monitored by the thermocouple 18.

The cleaning process was performed after wiping the inner wall of the quartz tube 1*a* with a cloth impregnated with ethyl alcohol. Specifically, without placing a substrate on the wafer stage 17, hydrogen gas at 400 sccm and water vapor at 100 sccm were flowed and plasma was generated by supplying a microwave power of 500 W at a pressure of 3 Torr. In 30 seconds after the start of electric discharge, the temperature of the thermocouple rose from 23° C. (room temperature) to 30° C. and a steady state was established. As the electric discharge continued, a temperature of the thermocouple rose to 500° C. in about 5 minutes.

Figure 9:
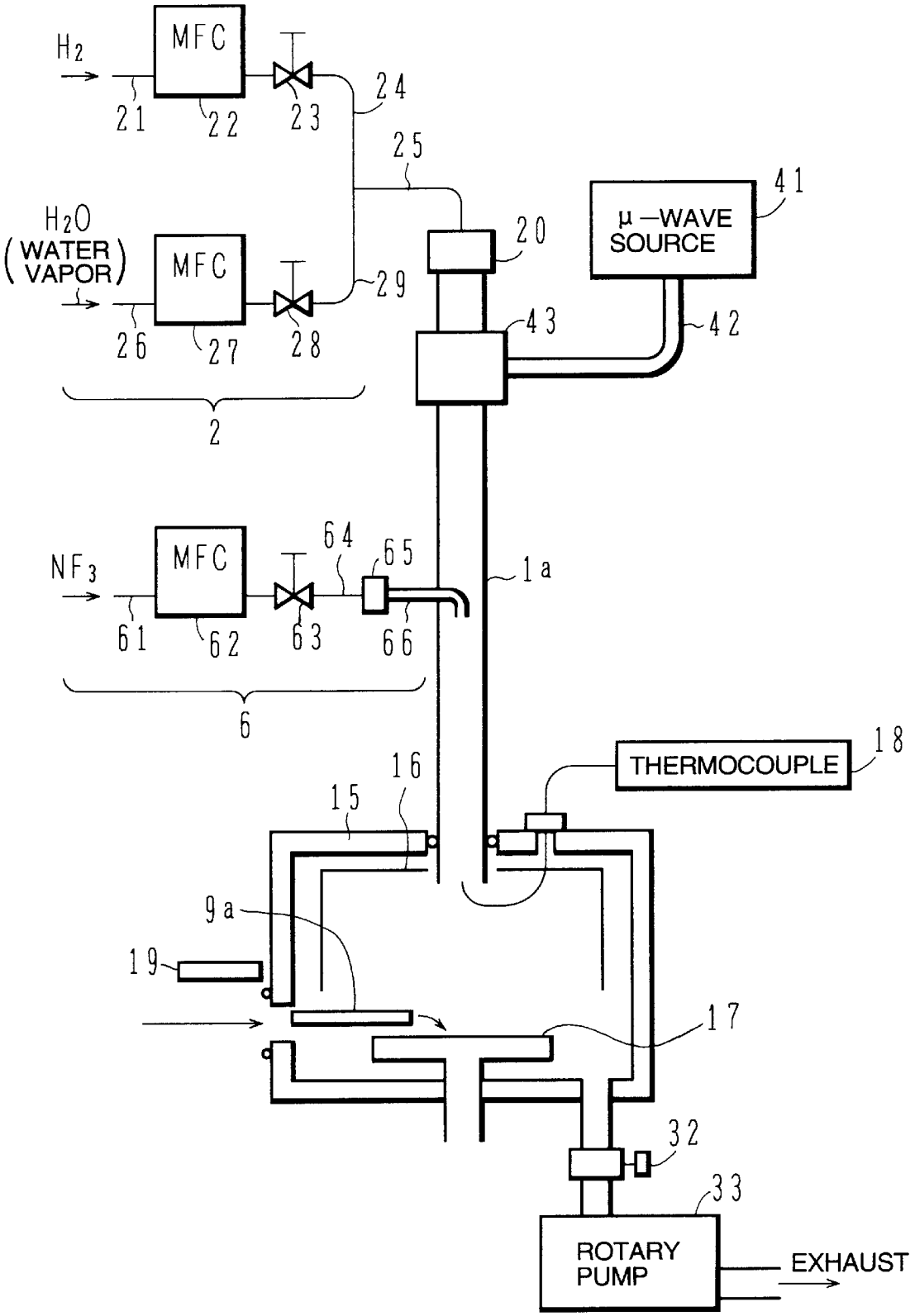

As shown in FIG. 9, a wafer 9*a* with a native oxide film was transported in a cleaned hydrogen plasma down-stream apparatus. Specifically, the wafer port 19 of the chamber 15 was opened, and the wafer 9*a* with a native oxide film was transported therein and placed on the wafer stage 17. The wafer 9*a* is a silicon wafer formed with a native oxide film of a thickness of about 1.3 nm by using sulfuric acid and hydrogen peroxide aqueous solution.

It is preferable to transport the wafer as soon as possible because the chamber 15 is exposed to the air when the wafer is placed on the wafer stage. With this apparatus, the transport process was completed in about 10 seconds.

Thereafter, the wafer port 19 was closed to recover the original state shown in FIG. 8. Hydrogen gas was flowed at 400 sccm and plasma was generated at a microwave power of 500 W. Next, nitrogen fluoride ($NF_3$) was introduced at 180 sccm and water vapor at 100 sccm was added to hydrogen gas. A pressure of the quartz tube was set to 2 Torr and a hydrogen plasma down-stream process was performed for 10 minutes. Thereafter, a supply of water vapor and nitrogen fluoride was stopped in this order, and then generation of plasma was stopped. While hydrogen gas is flowed at 400 sccm, the pressure was lowered to 1 Torr and the silicon wafer was heated at 100° C. for 3 minutes by the heater 12. A supply of hydrogen gas was then stopped and the silicon wafer 9*a* was taken out of the chamber 15. The processed silicon wafer indicated water repellency, which means that the native oxide was removed.

For the purpose of comparison, after the inner wall of the quartz tube was wiped with a cloth impregnated with ethyl alcohol, the cleaning process was performed only for 30 seconds and terminated at the thermocouple temperature of about 30° C. Thereafter, a silicon wafer with a native oxide film was transported and the native oxide film removing process was performed under the same conditions. In this case, the surface of the processed wafer indicated no water repellency, which means that the native oxide film was not removed completely.

In the processes of manufacturing a semiconductor device such as a MOS transistor, after a gate electrode of the transistor is formed, impurity ions are implanted for forming source and drain regions. Thereafter, a silicon oxide film is deposited by CVD, and a contact hole is formed in the silicon oxide film utilizing photolithography and etching. After the native oxide film removing process is performed, an electrode forming process for the source/drain electrodes is performed.

With the structure of the apparatus shown in FIGS. 8 and 9, the chamber 15 and quartz tube 1*a* are exposed to the air when a silicon wafer is transported. In order to retain the effect of cleaning, it is preferable not to expose the surface of the cleaned quartz to the air.

Figure 10:
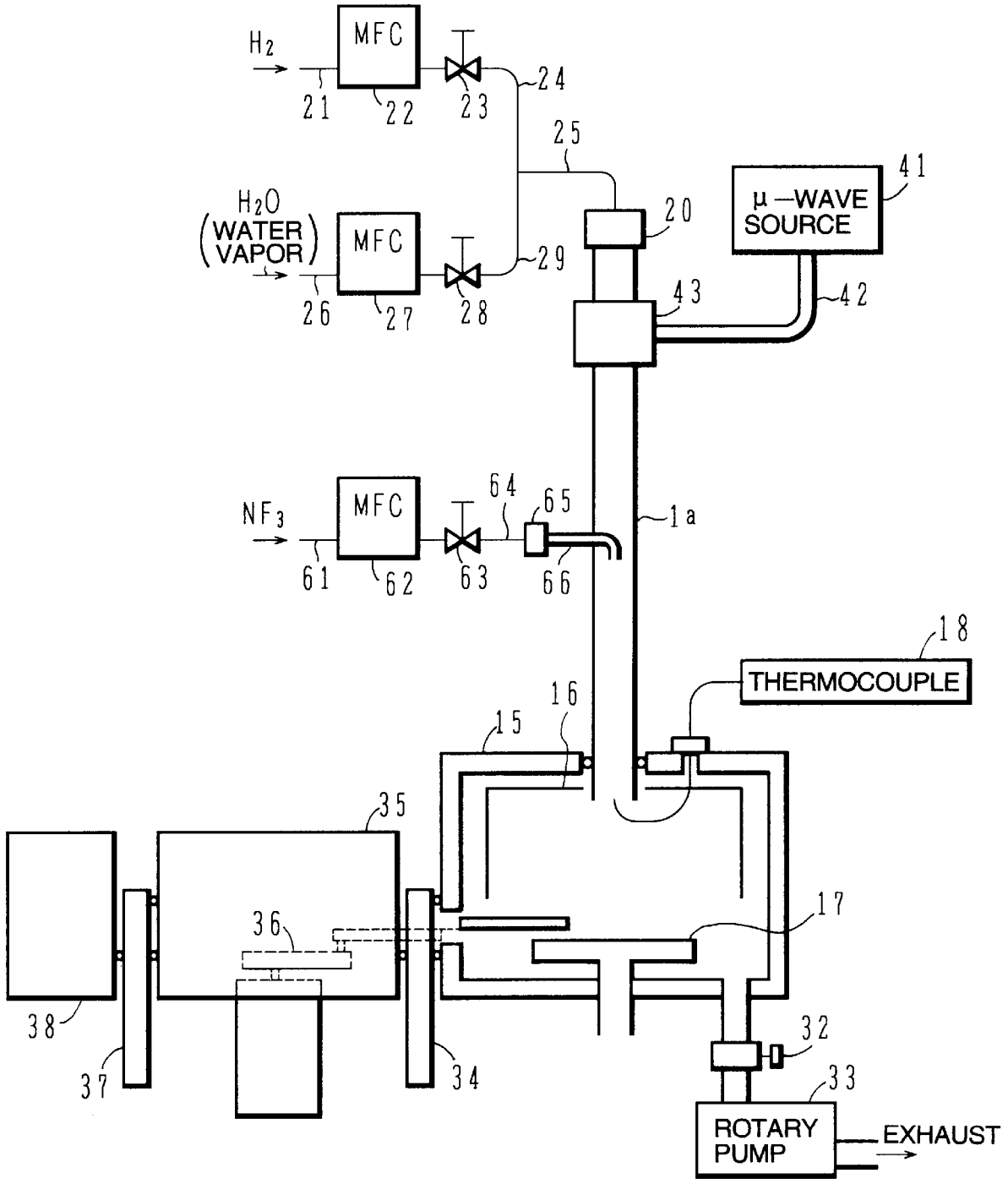
FIG. 10 is a schematic diagram partially in section of a hydrogen plasma down-stream apparatus illustrating a method of cleaning according to still another embodiment of the invention.

FIG. 10 shows the structure of a hydrogen plasma down-stream apparatus used by a cleaning process according to another embodiment. A gate valve 34 is mounted on a wafer port of a chamber 15 of the apparatus having the same structure as the apparatus shown in FIGS. 8 and 9. The chamber 15 is coupled via the gate valve 34 to a transport chamber 35. The transport chamber 35 is coupled via another gate valve 37 to a load lock chamber 38. A robot 36 is housed in the transport chamber 35. A silicon wafer is introduced into the load lock chamber 38 at a preparatory stage.

In operation of the apparatus shown in FIG. 10, a silicon wafer is transported into the load lock chamber 38 prior to the cleaning process, and the transport chamber 35 and load lock chamber 38 are evacuated. In the wafer transport process, the gate valves 34 and 37 are opened and a silicon wafer is transported from the load lock chamber 38 to the chamber 15 and placed on the wafer stage 17, while maintaining the vacuum state. In the above manner, the native oxide film removing process can be performed after the cleaning process while maintaining the vacuum state of the quartz tube 1*a* and chamber 15.

The present invention has been described in connection with the preferred embodiments. The invention is not limited only to the above embodiments. For example, the structure of a gas phase process system may be changed in various ways. A thermocouple may be dismounted once the process conditions are settled. A gas phase process system may be connected to another gas phase process system. Other types of semiconductor devices may be manufactured and the native oxide film removing process may be changed in various ways. It is apparent to those skilled in the art that various modifications, improvements, combinations and the like can be made without departing from the scope of the appended claims.

We claim:

1. A method of cleaning a gas flow path of a down-stream apparatus, comprising the steps of:

introducing a gas including a mixture of hydrogen gas and water vapor into the apparatus, said water vapor serving as an oxygen source;

generating plasma of the gas in a plasma generating space within said down-stream apparatus, said plasma including oxygen atoms and hydrogen radicals; and directing said plasma down-stream along said gas flow path, wherein said hydrogen radicals combine with and remove contaminants in said gas flow path, before placing a material to be processed within said down-stream apparatus, and wherein said gas flow path comprises an inner wall made of silicon oxide.

2. A method according to claim 1, wherein said silicon oxide is fused quartz.

3. A method of cleaning a gas flow path of a down-stream apparatus, comprising the steps of:

generating plasma of a gas containing oxygen and hydrogen in a plasma generating space within said down-stream apparatus;

directing said plasma down-stream along said gas flow path to clean said gas flow path, before placing a material to be processed within said down-stream apparatus, wherein said gas flow path includes an inner wall made of silicon oxide; and using a metal sheath thermocouple to monitor a temperature at a down-stream position from said gas flow path.

4. A method of cleaning a gas flow path of a down-stream apparatus, comprising the steps of:

generating plasma of a gas containing oxygen and hydrogen in a plasma generating space within said down-stream apparatus; and directing said plasma down-stream alone said gas flow path to clean said gas flow path, before placing a material to be processed within said down-stream apparatus, wherein said gas flow path includes an inner wall made of silicon oxide, and wherein said generating plasma step includes adding nitrogen fluoride at a position down-stream from said plasma generating space.

5. A method of cleaning a gas flow path of a down-stream apparatus, comprising the steps of:

generating plasma of a gas containing oxygen and hydrogen in a plasma generating space within said down-stream apparatus; and directing said plasma down-stream along said gas flow path to clean said gas flow path, before placing a material to be processed within said down-stream apparatus, wherein said gas flow path includes an inner wall made of silicon oxide, wherein said oxygen is derived from water vapor introduced into the down stream apparatus, and wherein said generating plasma step includes the steps of generating plasma of hydrogen gas and thereafter adding water vapor.

6. A method of cleaning a gas flow path of a down-stream apparatus, comprising the steps of:

generating plasma of a gas containing oxygen and hydrogen in a plasma generating space within said down-stream apparatus; and directing said plasma down-stream along said gas flow path to clean said gas flow path, before placing a material to be processed within said down-stream apparatus;

wherein said gas flow path includes an inner wall made of silicon oxide, wherein said generating plasma step includes the steps of generating plasma of hydrogen gas at a plasma generating space, thereafter adding nitrogen fluoride at a position down-stream from said plasma generating space, and thereafter adding said oxygen at said plasma generating space.

7. A method according to claim 6, further comprising the step of using a metal sheath thermocouple to monitor a temperature at a position down-stream from said gas flow path.

8. A method for cleaning a gas flow path of a down-stream apparatus comprising the steps of:

(1) introducing a mixed gas of $H_2$ and $H_2O$;

(2) supplying microwaves from a microwave source to a microwave cavity to generate a plasma in a plasma generating region;

(3) directing said plasma down-stream along said flow path before placing a material to be processed within said down-stream apparatus; and (4) adding $NF_3$ gas at a location of about 20 cm down-stream from said plasma generating region before placing the material to be processed within said down-stream apparatus.

9. The method for cleaning a gas flow path of a down-stream apparatus according to claim 8, further comprising:

(5) positioning a distal end of a thermocouple about 120 cm down-stream from said plasma generating region to promote recombination of hydrogen atoms of said mixed gas of $H_2$ and $H_2O$ to hydrogen molecules, and to detect hydrogen concentration.

10. The method for cleaning a gas flow path of a down-stream apparatus according to claim 9, wherein said thermocouple is covered with stainless steel to promote recombination of said hydrogen atoms to hydrogen molecules.

11. The method for cleaning a gas flow path of a down-stream apparatus according to claim 9, wherein said gas flow path comprises an inner wall made of silicon oxide.

12. The method for cleaning a gas flow path of a down-stream apparatus according to claim 11, wherein said silicon oxide is fused quartz.

13. The method for cleaning a gas flow path of a down-stream apparatus according to claim 8, wherein said location is about 40 cm down-stream from said plasma generating region.

* * * * *